US009050602B2

(12) United States Patent
Ruola et al.

(10) Patent No.: US 9,050,602 B2
(45) Date of Patent: Jun. 9, 2015

(54) REFINING SURFACE FOR A REFINER

(75) Inventors: Ville Ruola, Valkeakoski (FI); Christer Hedlund, Katrineholm (SE)

(73) Assignee: Valmet Technologies, Inc., Espoo (FI)

( * ) Notice: Subject to any disclaimer, the term of this patent is extended or adjusted under 35 U.S.C. 154(b) by 897 days.

(21) Appl. No.: 13/262,116

(22) PCT Filed: Mar. 16, 2010

(86) PCT No.: PCT/FI2010/050200

§ 371 (c)(1),
(2), (4) Date: Oct. 19, 2011

(87) PCT Pub. No.: WO2010/112667

PCT Pub. Date: Oct. 7, 2010

(65) Prior Publication Data

US 2012/0032011 A1 Feb. 9, 2012

(30) Foreign Application Priority Data

Apr. 3, 2009 (FI) ..... 20095370

(51) Int. Cl.
*B02C 7/12* (2006.01)
*D21D 1/30* (2006.01)

(52) U.S. Cl.
CPC . *B02C 7/12* (2013.01); *D21D 1/306* (2013.01)

(58) Field of Classification Search
CPC ..... B02C 7/12; D21D 1/30; D21D 1/303; D21D 1/306; D21D 1/006; D21D 1/008
See application file for complete search history.

(56) References Cited

U.S. PATENT DOCUMENTS

| | | | |
|---|---|---|---|
| 1,795,603 | A | 3/1931 | Hussey |
| 4,166,584 | A | 9/1979 | Asplund |
| 6,616,078 | B1 | 9/2003 | Gingras |

FOREIGN PATENT DOCUMENTS

| | | | |
|---|---|---|---|
| CA | 1185471 | A1 | 4/1985 |
| WO | 2010112667 | A1 | 10/2010 |

OTHER PUBLICATIONS

International Search Report for PCT/FI2010/050200.
Written Opinion of the International Searching Authority for PCT/FI2010/050200.

*Primary Examiner* — Shelley Self
*Assistant Examiner* — Matthew G Katcoff
(74) *Attorney, Agent, or Firm* — Stiennon & Stiennon

(57) ABSTRACT

A refining surface (1, 2) of a refiner for defibrating lignocellulose-containing material has a feed edge (14) and a discharge edge (15) and has a first blade groove (17*a*) and a second blade groove (17*b*), with a blade bar (16) therebetween. A distance (D, D17*a*, D17*b*) of the bottom (18) of the first blade groove (17*a*) and the second blade groove (17*b*) from an upper surface (16*a*) of the blade bar (16) is arranged, at least in a part, to change substantially continuously in a direction of travel (A) of the blade grooves. The distance of the bottom of the second blade groove from the upper surface of the blade bar deviates from the distance of the bottom of the first blade groove from the upper surface of the blade bar at substantially the same distance (SD) from the feed edge of the refining surface.

23 Claims, 4 Drawing Sheets

REFINING SURFACE FOR A REFINER

CROSS REFERENCES TO RELATED APPLICATIONS

This application is a U.S. national stage application of International App. No. PCT/FI2010/050200, filed on Mar. 16, 2010, the disclosure of which is incorporated by reference herein, and claims priority on Finnish App. 20095370, filed on Apr. 3, 2009.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a refining surface of a refiner for a refiner intended for defibrating lignocellulose-containing material, which refining surface has a feed edge directed in the direction of the feed flow of the material to be refined and a discharge edge directed in the direction of the discharge flow of the refined material and which refining surface comprises at least one first blade groove and at least one second blade groove, between which there is a blade bar.

Further, the invention relates to a blade segment of a refining surface for a refiner intended for defibrating lignocellulose-containing material, which blade segment is arrangeable to form a part of the refining surface of the refiner and which blade segment has a refining surface of the blade segment, the refining surface having a feed edge directed in the direction of the feed flow of the material to be refined and a discharge edge directed in the direction of the discharge flow of the refined material, and the refining surface of the blade segment comprising at least one first blade groove and at least one second blade groove, between which there is a blade bar.

Further, the invention relates to a refiner for defibrating lignocellulose-containing material.

Refiners used for manufacturing mechanical pulp typically comprise two or more refiner elements positioned oppositely and rotating relative to each other. The fixed, i.e. stationary, refiner element is called the stator of the refiner, the rotating or rotatable refiner element being called the rotor of the refiner. In disc refiners, the refiner elements are disc-like, and in cone refiners, the refiner elements are conical. In addition to disc refiners and cone refiners, there are also what are called disc-cone refiners, where disc-like refiner elements come first in the flow direction of the material to be defibrated, and after them the material to be defibrated is refined further between conical refiner elements. Furthermore, there are also cylindrical refiners, where both the stator and the rotor of the refiner are cylindrical refiner elements. The refining surfaces of the refiner elements are formed by blade bars, i.e. bars, and blade grooves, i.e. grooves, between them. The task of the blade bars is to defibrate the lignocellulosic material, and the task of the blade grooves is to transport both material to be defibrated and material already defibrated on the refining surface. In disc refiners, which represent the most common refiner type, the material to be refined is usually fed through an opening in the middle of the stator, i.e. on the inner periphery of the refining surface of the stator, to the space between the refining surfaces of the refiner discs, i.e. to a blade gap. The refined material is discharged from the blade gap, from the outer periphery of the refining surfaces of the refiner discs, to be fed onwards in the pulp manufacturing process. The refining surfaces of the refiner discs may be either surfaces formed directly on the refiner discs, or they may be formed as separate blade segments positioned adjacent to each other in such a way that each blade segment forms a part of a continuous refining surface.

Usually, dams connecting two adjacent blade bars to each other are positioned at the bottom of the blade grooves of the refining surfaces of both the stator and the rotor of the refiner. The task of the dams is to guide material to be refined and material already refined to the space between the blade bars of opposite refining surfaces to be further refined. Since the dams guide the material to be refined to the space between opposite blade bars, refining the material can be promoted thanks to the dams. Simultaneously, however, the dams cause the steam flow taking the material to be refined onwards in the blade grooves to decrease, and prevent passage of the material to be refined and the material already refined on the refining surface by restricting the cross-sectional flow area of the blade grooves. This, in turn, leads to blockages on the refining surface, which then results in a decrease in the production capacity of the refiner, non-uniformity of the quality of the refined material and an increase in the energy consumed for the refining.

U.S. Pat. No. 4,166,584 discloses a refiner whose refining surfaces have blade bars. Between the blade bars, pocket-like structures are formed in the radial direction of the refining surfaces in such a way that the pocket-like structures in opposite refining surfaces are positioned partly staggered in the radial direction of the refining surfaces. Thus, the material to be refined may be moved, by the effect of the pocket-like structures, onwards on the refining surfaces of the refiner in such a way that the material to be refined moves from one pocket-like structure into the pocket-like structure on the opposite refining surface, hereby forcing the material to be refined to move into the blade gap and thus boosting the refining effect on the material to be refined.

U.S. Pat. No. 6,616,078 discloses a refiner whose refining surfaces have blade bars and between them blade grooves. The depth of the blade grooves in the feed zone of the refining surfaces is arranged to change in such a way that when the depth of the blade groove on one refining surface is great, the depth of the blade groove on the opposite refining surface is small at the corresponding point, i.e. the blade groove is shallow at this point, whereby the shallow portion of the groove forces the material to be refined to move to the opposite refining surface.

By means of the arrangements disclosed in both reference publications, guiding the material to be refined to the space between the refining surfaces can be boosted, and thus the refining effect can also be boosted. However, one weakness in both solutions is, for example, that the solutions affect to a large extent only the moving of the material to be refined in the depth direction of the refining surfaces from one refining surface to another refining surface. Thus, the movement of the material to be refined onwards in the blade gap remains rather inefficient in the case of these solutions. Further, since the change in the depth of the blade groove is implemented only in the feed zone in the case of U.S. Pat. No. 6,616,078, its effect in the area of the blade bars and the blade grooves, i.e. in the actual refining zone, remains insignificant.

SUMMARY OF THE INVENTION

An object of this invention is to provide a novel-type refining surface of a refiner.

The refining surface according to the invention has a distance of the bottom of both the first blade groove and the second blade groove from an upper surface of the blade bar arranged, at least in a part of said blade grooves, to change substantially continuously in a direction of travel of the blade grooves; and that in said part of the blade grooves, the distance of the bottom of the first blade groove and the distance of the bottom of the second blade groove from the upper surface of the blade bar are arranged, in the direction of travel of the blade grooves, in such a way relative to each other that the distance of the bottom of the second blade groove from the upper surface of the blade bar deviates from the distance of the bottom of the first blade groove from the upper surface of the blade bar at substantially the same distance from the feed edge of the refining surface.

The blade segment according to the invention has a distance of the bottom of both the first blade groove and the second blade groove from an upper surface of the blade bar arranged, at least in a part of said blade grooves, to change substantially continuously in a direction of travel of the blade grooves; and that in said part of the blade grooves, the distance of the bottom of the first blade groove and the distance of the bottom of the second blade groove from the upper surface of the blade bar are arranged, in the direction of travel of the blade grooves, in such a way relative to each other that the distance of the bottom of the second blade groove from the upper surface of the blade bar deviates from the distance of the bottom of the first blade groove from the upper surface of the blade bar at substantially the same distance from the feed edge of the refining surface.

The refining surface of a refiner for defibrating lignocellulose-containing material comprises a feed edge directed in the direction of the feed flow of the material to be refined, and a discharge edge directed in the direction of the discharge flow of the refined material, and the refining surface further comprises at least one first blade groove and at least one second blade groove, between which there is a blade bar. The distance of the bottom of both the first blade groove and the second blade groove from the upper surface of the blade bar is arranged, at least in a part of said blade grooves, to change substantially continuously in the direction of travel of the blade grooves; and that in this part of the blade grooves, the distance of the bottom of the first blade groove and the distance of the bottom of the second blade groove from the upper surface of the blade bar are arranged, in the direction of travel of the blade grooves, in such a way relative to each other that the distance of the bottom of the second blade groove from the upper surface of the blade bar deviates from the distance of the bottom of the first blade groove from the upper surface of the blade bar at substantially the same distance from the feed edge of the refining surface.

The solution provides dynamic movement of the material to be refined between the refining surface of the stator and the refining surface of the rotor. Simultaneously, the number of conventional dams can be restricted, or they may be completely eliminated, which promotes the passage of both the material to be refined and the steam possibly generated in the refining on the refining surface. The solution can be applied both on the refining surface of the stator and on the refining surface of the rotor but the solution is of greater advantage when applied particularly on the refining surface of the stator where, due to the fixed, i.e. stationary, structure of the stator, there is normally no such impact on the material to be refined that would significantly promote the movement of the material on the refining surface.

BRIEF DESCRIPTION OF THE DRAWINGS

Some embodiments of the invention are disclosed in greater detail in the attached drawings.

DESCRIPTION OF THE PREFERRED EMBODIMENTS

Figure 1:
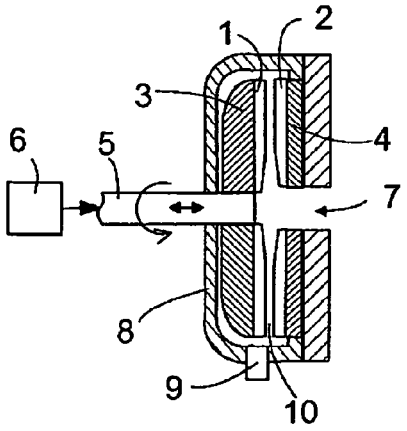
FIG. 1 shows schematically a side view in cross-section of a conventional disc refiner.

For the sake of clarity, the figures show some embodiments of the invention simplified. Similar parts are denoted with the same reference numerals in the figures.

FIG. 1 shows schematically a side view in cross-section of a conventional disc refiner. The disc refiner according to FIG. 1 comprises two disc-like refining surfaces 1 and 2, which are arranged coaxially relative to each other. The first refining surface 1 is in a rotating refiner element 3, i.e. in a rotor 3 of the refiner, and the second refining surface 2 is in a fixed refiner element 4, i.e. in a stator 4 of the refiner. The refining surfaces 1 and 2 in the refiner elements 3 and 4 may be formed directly therein, or they may be formed of separate blade segments in a manner known as such. The rotor 3 of the refiner is rotated via a shaft 5 in a manner known as such by means of a motor not shown for the sake of clarity. In connection with the shaft 5, a special loader 6 is also arranged, which is connected to affect the rotor 3 via the shaft 5 in such a way that the rotor 3 can be pushed towards the stator 4 to adjust a gap 10 between them, i.e. a refiner mouth 10, i.e. a blade gap 10.

The lignocellulose-containing material to be defibrated is fed via an opening 7 in the middle of the second refining surface 2 to the refiner mouth between the refining surfaces 1 and 2, where it is defibrated and refined. The lignocellulose-containing material to be defibrated may be fed to a refiner mouth also via openings in the second refining surface 2, not shown for the sake of clarity. The defibrated lignocellulose-containing material is discharged from the outer edge of the refiner mouth between the refining surfaces 1 and 2 to the inside of a refiner chamber 8 and further out of the refiner chamber 8 along a discharge channel 9.

Figure 2:
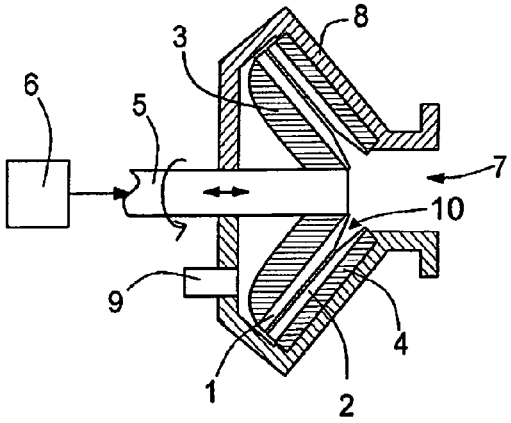
FIG. 2 shows schematically a general side view in cross-section of a conventional cone refiner.

FIG. 2 shows schematically a side view in cross-section of a conventional cone refiner. The cone refiner according to FIG. 2 comprises two conical refining surfaces 1 and 2 set coaxially within each other. The first refining surface 1 is in the conical refiner element 3, i.e. in the rotor 3 of the refiner, and the second refining surface 2 is in the fixed conical refiner element 4, i.e. in the stator 4 of the refiner. The refining surfaces 1 and 2 of the refiner elements 3 and 4 may be formed either directly therein, or they may be formed of separate blade segments in a manner known as such. The rotor 3 of the refiner is rotated via the shaft 5 in a manner known as such by means of a motor not shown for the sake of clarity. In connection with the shaft 5, a special loader 6 is also arranged which is connected to affect the rotor 3 via the shaft 5 in such a way that the rotor 3 can be pushed towards the stator 4 to adjust the blade gap 10 between them.

The lignocellulose-containing material to be defibrated is fed via an opening 7 in the middle of the second refining surface 2 into the conical refiner mouth between the refining surfaces 1 and 2, where it is defibrated and refined. The defibrated lignocellulose-containg material is discharged from the outer edge of the refiner mouth between the refiner elements 3 and 4 to the inside of the refiner chamber 8 and further out of the refiner chamber 8 along a discharge channel 9.

In addition to disc refiners and cone refiners, there are also what are called disc-cone refiners where disc-like refiner elements come first in the flow direction of the material to be defibrated, after which the material to be defibrated is further refined between conical refiner elements. Furthermore, there are also cylindrical refiners where both the stator and the rotor of the refiner are cylindrical refiner elements. The general structural and operating principle of the different refiners are known as such to a person skilled in the art, so they will not be described in more detail in this context.

Figure 3:
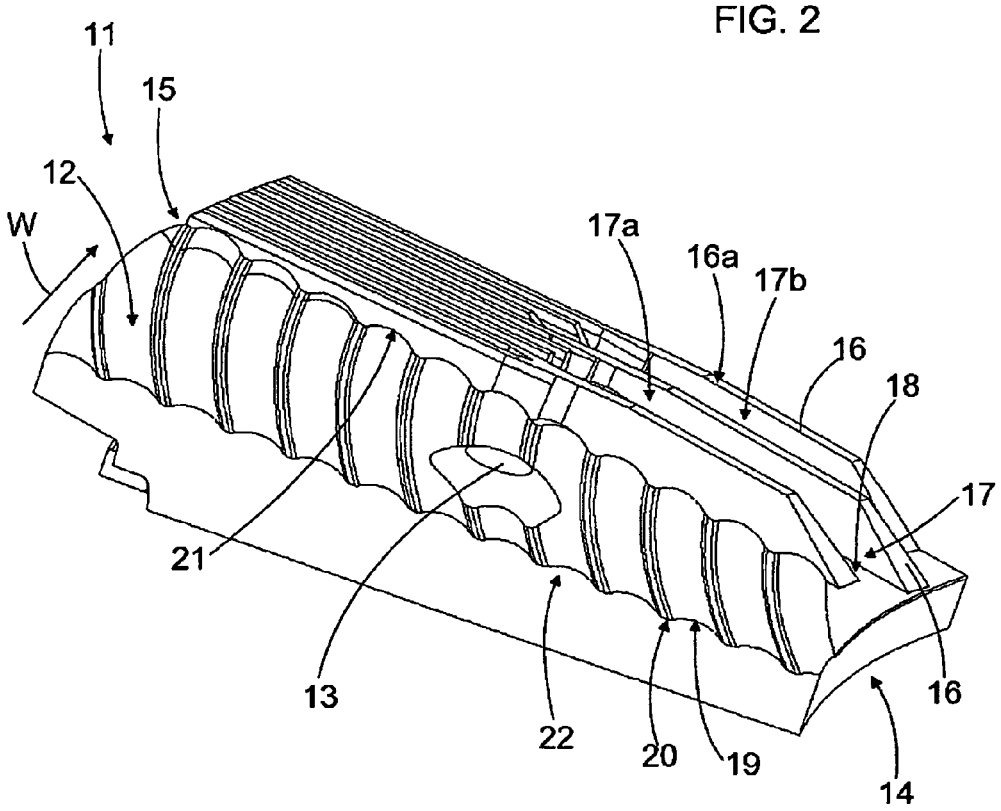
FIG. 3 shows schematically a blade segment with the blade bars removed from part of the blade segment, seen diagonally from above.

FIG. 3 shows schematically a general view of a blade segment 11 of the refining surface of a refiner, seen diagonally from above, which blade segment can be used to form a part of the whole refining surface of the stator or rotor. The blade segment 11 comprises a feed edge 14 of the blade segment 11 or a refining surface 12, directed in the direction of the feed flow of the material to be refined, and a discharge edge 15 of the blade segment 11 or a refining surface 12, directed in the direction of the discharge flow of the refined material. The blade segments 11 can be fastened to the stator or the rotor of the refiner with, for example, bolt-nut fastening via a mounting opening 13 in the blade segment 11, for example. The refining surface 12 of the blade segment 11 further comprises blade grooves 17 going from the direction of the feed edge 14 in the direction of the discharge edge 15, which blade grooves are separated from each other by means of blade bars 16. The blade bars 16 and blade grooves 17 form the refining surface 12 of the blade segment 11.

Figure 4:
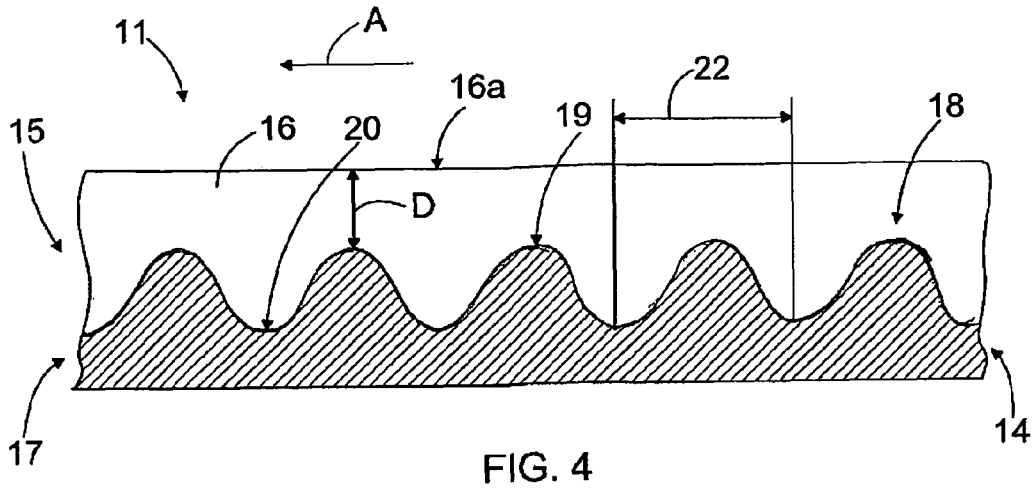
FIG. 4 shows schematically a side view of a blade segment similar to the one in FIG. 3, cross-sectioned at the point of a blade groove.

To clarify one embodiment of the solution shown in FIG. 3, the blade bars 16 have been removed from the blade segment 11 according to FIG. 3 over half of the refining surface 12 of the blade segment 11, whereby the shape of a bottom 18 of the blade groove 17, characteristic of the solution, can be seen more clearly. FIG. 4 shows schematically a side view of a blade segment similar to the one in FIG. 3, cross-sectioned at the point of a blade groove 17. The bottom 18 of the blade grooves 17 of the blade segment 11, shown in FIG. 3, is shaped wave-like in such a way that a distance D of the bottom 18 of the blade grooves 17 from the blade bar's 16 upper surface 16*a*, which corresponds, at the same time, to the upper surface of the refining surface 12, is arranged to change substantially continuously in the direction of the blade grooves 17, i.e. in the direction of travel of the blade grooves 17, which direction is shown by arrow A in FIG. 4. In FIG. 4, the distance D of the bottom 18 of the blade groove 17 in question is denoted in an exemplary manner at one wave crest 19 of the wave shape. In the embodiment shown in FIG. 3, the bottom 18 of each blade groove 17 is shaped wave-like substantially in its entirety; in other words the distance of the bottom 18 of each blade groove 17 from the upper surface 16*a* of the blade bar 16 is arranged to change substantially continuously in the direction of the blade grooves 17 either over the whole area of the blade groove 17 or over nearly the whole area of the blade groove 17. In FIG. 3, the wave-like shape of the bottom 18 of the blade grooves 17 is thus formed of several individual waves 22 successive relative to each other in the direction of travel of the blade groove 17. Each wave comprises a wave crest 19 at which the distance of the bottom 18 of the blade groove 17 from the upper surface 16*a* of the blade bar 16 is at its smallest, and a wave hollow 20 at which the distance of the bottom of the blade groove 17 from the upper surface 16*a* of the blade bar 16 is at its greatest. The distance of two successive wave hollows from each other corresponds to the wavelength of the wave 22. In FIG. 3, arrow 21 further indicates a section point between the bottom 18 of the blade groove 17 and the side surface of the blade bar 16, which section point also illustrates the wave-like shape of the bottom 18 of the blade groove 17.

The blade segment 11 according to FIG. 3 thus comprises, in the direction of travel of the blade grooves 17, several individual waves 22, of which each individual wave 22 is further arranged to go in the lateral direction of the blade segment 11, illustrated by means of arrow W, across several or even all blade grooves 17 of the blade segment 11 in an oblique direction in such a way that the distance of the wave crest 19 of each wave 22 from the feed edge 14 of the blade segment 11, for example, is unequal between two adjacent blade grooves 17.

In the blade segment 11 according to FIG. 3, the wave-like shape of the bottom 18 of the blade grooves 17 is thus implemented in such a way that in the direction of travel of the blade grooves 17, the wave-like shape of the bottom of the blade groove 18 is formed substantially over the whole area of the blade groove 17. In the direction transverse to the direction of travel of the blade grooves 17, the wave-like shape of the bottom 18 of the blade grooves 17 is thus implemented in such a way in the blade segment of FIG. 3 that each wave 22 goes continuously via adjacent blade grooves 17 in such a way that for example the distance of the wave crest 19 of each wave 22 from the feed edge 14 of the blade segment 11 is unequal between two adjacent blade grooves 17.

The refining surface 12 of the blade segment 11 may, however, be formed in the direction of travel of the blade grooves 17 in such a way that the bottom 18 of one or more blade grooves 17 comprises only one wave or several waves 22 in such a way that the wave-like shaping of the bottom 18 of the blade groove 17 does not extend over the whole area of the bottom 18 of the blade groove 17 in the direction of travel of the blade groove 17. Compared with FIG. 3, such a situation would thus correspond to some of the waves 22 shown in FIG. 3 being removed from the refining surface 12, whereby the bottom of the groove could be, in this area, for instance even or inclined. In the case of an even groove bottom, the depth of the groove is constant, while in the case of an inclined groove bottom, the depth of the groove changes linearly. In the case of an inclined groove bottom, i.e. when the groove bottom changes linearly, the bottoms of two adjacent blade grooves can be arranged to change linearly in such a way that the distances of the bottoms of adjacent blade grooves from the upper surface 16*a* of the blade bar 16 between them are unequal at the same distance from the feed edge 14 of the refining surface.

Further, the refining surface 12 of the blade segment 11 may be formed in the lateral direction W of the blade segment 11, i.e. in the direction transverse to the direction of travel of the blade grooves 17, in such a way that the wave 22 is not necessarily continuous in this direction but has a discontinuous point at one or more blade grooves 17; in other words, it is possible that the blade segment 11 has blade grooves 17 where there is no individual wave 22 at all in the lateral direction of the blade segment 11, even if such a wave 22 existed in the blade grooves adjacent to this blade groove. In such a case, the wave 22 in the lateral direction of the blade segment 11 is thus interrupted at one of the blade grooves 17. Even in a case like this, the blade segment 11 has, nevertheless, at least two or more blade grooves 17 adjacent to each other, where at least an individual wave 22 is arranged to go in the direction of the lateral direction W of the blade segment.

Figure 5:
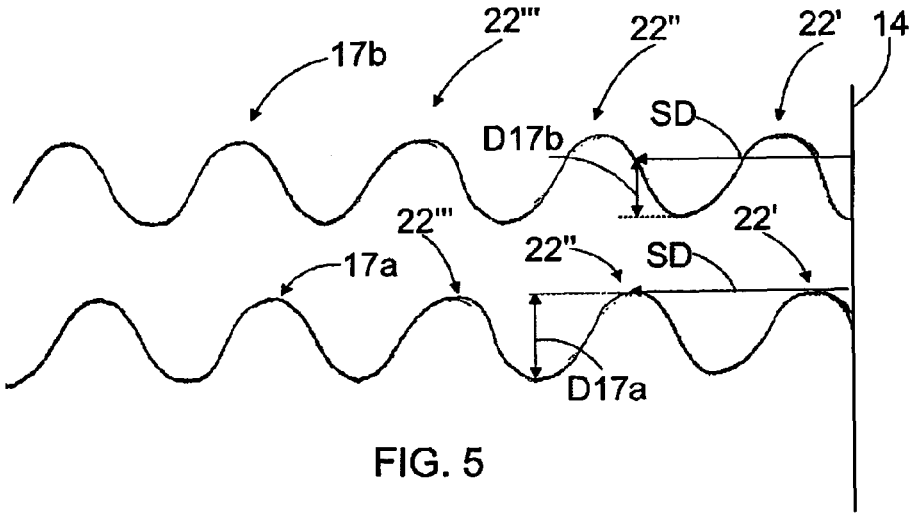
FIG. 5 shows schematically a side view of the shape of the bottoms of two adjacent blade grooves.

Thus, according to the solution, the refining surface 12 of the blade segment 11 has at least one first blade groove denoted by reference numeral 17*a* in FIG. 3, and at least one second blade groove denoted by reference numeral 17*b* in FIG. 3, which first blade groove 17*a* and second blade groove 17*b* are adjacent to each other in such a way that there is a blade bar 16 between them. Further, according to the solution, resulting from the wave-like shape in at least some part of the bottom 18 of the blade grooves 17*a* and 17*b*, the distance D of the bottom 18 of both the first blade groove 17*a* and the second blade groove 17*b* from the upper surface 16*a* of the blade bar 16 is arranged, in the direction of travel of the blade grooves, to change substantially continuously in this part of the blade grooves 17*a* and 17*b*. A substantially continuous change means, in this context, such wave-like shaping of the bottom 18 of the blade groove 17 where the distance D of the bottom 18 of the blade groove 17 from the upper surface 16*a* of the blade bar 16 changes, at least in a part of the blade groove, substantially all the time non-linearly when one moves along the blade groove in its direction of travel A. However, in wave-like shaping or in a waveform, there may be straight portions and/or portions rising or descending by a constant angle due to reasons relating to the manufacturing technique. Furthermore, according to the solution, the distance D of the bottom 18 of the first blade groove 17*a* from the upper surface 16*a* of the blade bar 16 and the distance D of the bottom 18 of the second blade groove 17*b* from the upper surface 16*a* of the blade bar are arranged, in the direction of travel of the blade grooves 17*a*, 17*b*, in such a way relative to each other that the distance D of the bottom 18 of the second blade groove 17*b* from the upper surface 16*a* of the blade bar 16 deviates or is unequal compared with the distance D of the bottom 18 of the first blade groove 17*a* from the upper surface 16*a* of the blade bar 16 at substantially the same distance from the feed edge 14 of the refining surface 12. In other words, an individual wave 22 is arranged to go, in the lateral direction W of the blade segment 11, from one blade groove 17 to another in such a way that when the shape of the cross-section of the wave 22 in the direction of travel of the blade groove 17 remains constant, for instance the distances D of the crest 19 or hollow 20 of the wave 22 from the feed edge 14 are unequal in two blade grooves 17 adjacent to each other. This is further illustrated in FIG. 5, where the top part shows the wave shape of the bottom 18 of the second blade groove 17*b* and the bottom part shows the wave shape of the bottom 18 of the first blade groove 17*a* when the wave shapes correspond to each other, there being waves 22', 22" and 22'" indicated in both wave shapes. It is seen from FIG. 5 that at a given distance SD from the feed edge 14 of the refining surface 12 of the blade segment 11, the distance of the bottom 18 of the second blade groove 17*b* from the upper surface 16*a* of the refining blade 16, i.e. from the upper surface of the refining surface, deviates from, i.e. is unequal to the distance of the bottom 18 of the first blade groove 17*a* from the upper surface 16*a* of the refining blade 16 at the same given distance SD because distances D17*b* and D17*a* of the bottoms of the grooves from the wave hollow are unequal at these points.

In the blade segment 11 shown in FIG. 3, the direction of travel of the blade grooves 17, as naturally also the direction of travel of the blade bars 16 between them, is a substantially straight line from the direction of the feed edge 14 of the blade segment 11 in the direction of the discharge edge 15 of the blade segment 11. Depending on the implementation of the refining surface, the blade bars 16 and the blade grooves 17 may, however, be in a curved line or at an angle relative to the feed edge 14 and/or the discharge edge 15.

In the direction of travel of the blade groove 17 of the refining surface 12, the wave shape of the bottom 18 of the blade groove 17 may be only in a part of one refining zone, or it may cover the whole refining zone. The wave shape of the bottom 18 of the blade groove 17 may, however, go from one refining surface to another. The refining surface means such an area of the refining surface where the refining properties of the refining surface remain substantially the same over the whole area. In the refining surface formed of blade segments, one blade segment may comprise one or more refining zones, or one blade segment may form only a part of one refining surface.

The solution provides dynamic movement of the material to be refined between the refining surface of the stator and the refining surface of the rotor. The solution can be applied both on the refining surface of the stator and on the refining surface of the rotor but the solution is of greater advantage when applied particularly on the refining surface of the stator where, due to the fixed, i.e. stationary, structure of the stator, there is normally no such impact on the material to be refined that would significantly promote the movement of the material on the refining surface.

Figure 6:
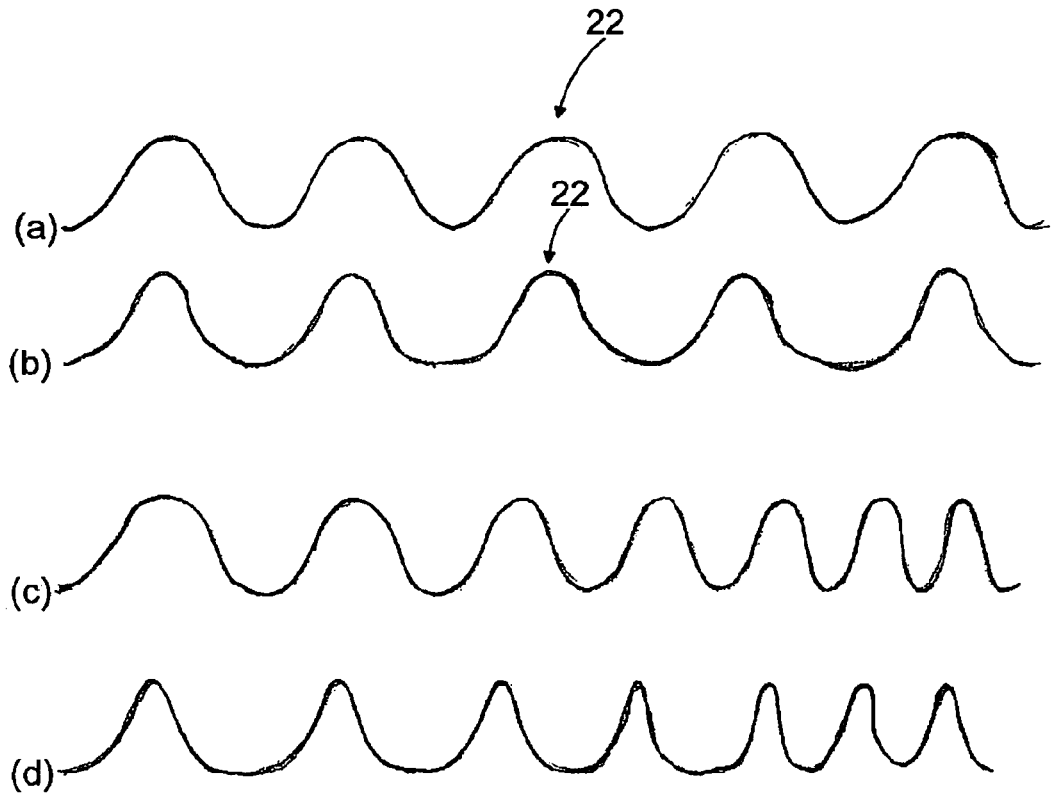
FIG. 6 shows schematically some possible shapes of the bottom of a blade groove.

FIG. 6 shows schematically various potential shapes for the wave 22 in the direction of the blade groove 17. Point (a) of FIG. 6 shows an ordinary sinusoidal wave. Point (b) of FIG. 6 shows a wave shape which resembles a sinusoidal wave shape but in which the rising and descending edges are steeper compared with an ordinary sine wave, i.e. the wave crests are narrower, and in which the shape of the wave hollow is flatter than in a conventional sine wave. Both of said wave shapes can, however, be regarded as regular wave shapes because the shape of each individual wave 22 is repeated identically in them, so that the wavelength remains substantially constant.

Further, point (c) in FIG. 6 shows for the bottom 18 of the blade groove 17 a third potential wave-like shape which starts as a sinusoidal wave shape, seen from the left, but where the cycle length of the wave keeps decreasing as one moves to the right, so that the wave crests become narrower and narrower. Further, point (d) in FIG. 6 shows for the bottom 18 of the blade groove 17 a fourth potential wave-like shape which proceeds from left to right in the figure in such a way that the wavelength of each of the following individual waves 22 is shorter than the wavelength of the preceding wave 22. Thus, what is common to the wave shapes shown at points (c) and (d) of FIG. 6 is that when one moves from left to right in FIG. 6, the cycle length of the wave 22 decreases. In other words, what is involved here is the wave shape of the bottom 18 of the blade groove 17 becoming denser, which is preferably implemented on the refining surface in such a way that the wavelength keeps decreasing as one moves from the direction of the feed edge of the refining surface in the direction of the discharge edge of the refining surface. Points (c) and (d) in FIG. 6 show some potential wave shapes where the cycle length of the wave may change or vary, but in addition to these examples, the wave shape of the bottom 18 of the blade groove 17 may be formed in several ways in the direction of the blade groove 17, so that it will comprise waves with different wavelengths. Thus, the wavelength of the waves 22 of the wave shape may vary in such a way, for example, that when one moves along the blade groove 17 from the direction of the feed edge of the refining surface in the direction of the discharge edge of the refining surface, the wavelength gets shorter from time to time and then longer again, or vice versa.

In the different wave shapes shown in FIG. 6, the distance between the wave hollow and the wave crest remains, in the elevational direction of the wave, substantially constant, but also such a wave shape in the direction of travel of the blade groove is feasible where the distance between the wave hollow and the wave crest may vary in the elevational direction of the wave shape.

The variation in the height of the wave shape of the bottom 18 of the blade groove 17 in the elevational direction of the blade groove, i.e. in the elevational direction of the wave shape, i.e. in the direction which is from the direction of the bottom of the blade groove 17 towards the direction of the upper surface 16*a* of the blade bar 16, may vary in a plurality of different ways. According to one embodiment, the variation in the height of the wave shape preferably takes place only at a height which is at the most 75% of the height of the blade groove 17 from the bottom 18 of the blade groove 17. The height of the blade groove 17 means the dimension from the lowest or deepest wave hollow 20 of the wave shape to the upper surface 16*a* of the blade bar 16, i.e. to the upper surface of the refining surface.

As described earlier, there may be a wave shape only in part of the blade grooves of the refining surface. This implementation is preferable particularly in rotors, whereby a greater volume flow can be generated in the refining space and thus also a greater effect that promotes the passage of the material to be refined on the refining surface. However, all blade grooves of the refining surface may have wave shapes, whereby there is at least one individual wave 22 in all blade grooves of the refining surface.

In the lateral direction of the refining surface, i.e., correspondingly, in the lateral direction W of the blade segment, an individual wave 22 proceeds in such a way that in two adjacent blade grooves 17, given points or locations of the cross-sectional shape of the wave 22 in the direction of the blade groove 17 are at mutually different distances from the feed edge of the refining surface. At such a point, the wave 22 thus proceeds in the lateral direction of the refining surface at an angle relative to the radius of the refining surface. However, it is hereby also possible for the wave to proceed in such a way in the lateral direction of the refining surface that the corresponding given points or locations of the cross-section of the wave 22 in the direction of the blade groove, i.e. the bottom of the blade groove, are at the same distances from the feed edge of the refining surface in two or more blade grooves which are not, however, blade grooves adjacent to each other.

According to an embodiment, it is feasible, however, that one single wave 22 proceeds in the lateral direction of the refining surface in such a way that given corresponding points or locations of the cross-section of the wave 22 in the direction of the blade groove, i.e. the bottom of the blade groove, are at different distances from the feed edge of the refining surface in all of the blade grooves through which this wave 22 is arranged to go.

Further, one or more waves in the lateral direction of the refining surface are arranged to proceed at an angle of 0 to 90 degrees in the portion on the side of the feed edge of the refining surface and at an angle of 0 to 90 degrees in the portion on the side of the discharge edge of the refining surface, measured from the direction of the refining surface radius. In the case of a cylindrical or cone refiner, the direction of the refining surface radius means that direction of the refining surface from the feed edge to the discharge edge of the refining surface whose projection is in the axial direction of the cylindrical or cone refiner surface. In other words, the distances of given mutually corresponding wave points or locations of the bottom 18 of both the first blade groove 17*a* and the second blade groove 17*b* from the feed edge of the refining surface are arranged in such a way in said blade grooves 17*a*, 17*b* that an imaginary, either straight or curved line combining the points or locations forms an angle of 0 to 90 degrees in the portion on the side of the feed edge of the refining surface, and an angle of 0 to 90 degrees on the discharge edge of the refining surface, measured from the direction of the refining surface radius.

According to an embodiment, at least 50% of the blade grooves 17 of the whole refining surface or one or more zones of the refining surface comprise such a shape of the bottom 18 of the blade grooves 17 that changes substantially continuously in a wave-like manner, so that the shape of the bottom 18 of the blade grooves 17, which changes in a wave-like manner, forms one or more waves in the lateral direction of the refining surface in such a way that an angle is formed between said one or more waves and the refining surface radius.

Further, in the lateral direction of the refining surface or in the lateral direction of the blade segment 11, each individual wave 22 may be formed in a plurality of ways with regard to whether the wave is to provide a pumping effect on the material to be refined, i.e. an effect promoting the passage of the material to be refined on the refining surface, or whether the wave is to provide a retaining effect on the material to be refined, i.e. an effect preventing or slowing down the passage is of the material to be refined on the refining surface. A pumping wave means a wave which produces for a pulp particle to be refined both a speed component in the circumferential direction of the refining surface, i.e. in the direction of the perpendicular of the blade segment radius, and a speed component in the direction of the refining surface radius, directed from the direction of the feed edge of the refining surface towards the direction of the discharge edge of the refining surface. A retaining wave means a wave which produces for a pulp particle to be refined both a speed component in the circumferential direction of the refining surface, i.e. in the direction of the perpendicular of the blade segment radius, and a speed component in the direction of the refining surface radius, directed from the direction of the discharge edge of the refining surface towards the direction of the feed edge of the refining surface. For example, when the individual waves 22 in FIG. 3 are viewed with the assumption that the blade segment shown in FIG. 3 rotates as a part of the whole refining surface of the rotor in the direction opposite to the direction indicated by arrow W in FIG. 3, each individual wave 22 has a pumping effect on the material to be refined. Likewise, when the individual waves 22 in FIG. 3 are viewed with the assumption that the blade segment shown in FIG. 3 rotates as a part of the whole refining surface of the rotor in the direction indicated by arrow W in FIG. 3, each individual wave 22 has a retaining effect on the material to be refined. Further, when the individual waves 22 in FIG. 3 are viewed with the assumption that the blade segment in FIG. 3 forms a part of the whole refining surface of the stator, and with the assumption that the rotor rotates in the direction indicated by arrow W in FIG. 3, the individual waves 22 of the refining surface of the stator have a pumping effect on the material to be refined. Further, when the individual waves 22 in FIG. 3 are viewed with the assumption that the blade segment in FIG. 3 forms a part of the whole refining surface of the stator, and with the assumption that the rotor rotates in the direction opposite to the direction indicated by arrow W in FIG. 3, the individual waves 22 of the refining surface of the stator have a retaining effect on the material to be refined.

The greatest pumping effect is achieved when the waves are at an angle of 45 degrees, measured from the refining surface radius. With wave angle values higher or lower than this, the pumping effect begins to decrease. The smallest usable angle of a pumping wave is about 5 degrees, the greatest one being about 85 degrees, measured from the direction of the radius. With angle values which are about 5 degrees lower and about 85 degrees higher than the angle, there is not much pumping in practice. With a very high value of the angle, the wave shape may be become very dense because then the rise in the lateral direction of the blade segment remains small when it is desirable that the waves go continuously or seemingly continuously from one blade segment to another.

When it is desirable to achieve an efficient pumping effect with the wave shape, the waves are positioned on the refining surface closer to an angle of 45 degrees than to an angle of 0 or 90 degrees, measured from the direction of the radius. A good pumping effect is achieved when the angle is selected to be 5 to 85 degrees, a more efficient pumping effect being achieved with an angle of 15 to 75 degrees.

When waves positioned in a retaining manner are used on the refining surface, corresponding angle values are possible, in other words the wave angle measured from the direction of the refining surface radius may be between 0 to 90 degrees retaining. Preferably, the angle is 5 to 85 degrees retaining, and more preferably 15 to 75 degrees retaining. The most efficient retaining effect is achieved with waves at a retaining angle of 45 degrees.

Positioning the waves at an angle of 15 to 75 degrees, measured from the radial direction, on the refining surface of the rotor promotes efficient turbulent movement of the material, which is to be refined on the refining surface, in the blade gap of the refiner. Closer to the feed edge of the refining surface, the pumping effect of the waves can be arranged to be even more efficient, especially when the circumferential speed on the refining surface close to the feed edge is lower than close to the discharge edge, i.e. in the case of a disc refiner or cone refiner, for example. An effect of this type is achieved by using a pumping angle of 30 to 60 degrees for the waves in the refining surface zone closest to the feed edge. Correspondingly, closer to the discharge edge of the refining surface or in the outermost zones of the refining surface, it may be preferable, due to a higher circumferential speed and a need to slow down the movement of the material, to select a less pumping wave angle for the rotor, whereby the preferable angle is, for example, 5 to 35 or 55 to 85 degrees, measured from the radial direction.

When the waves of both the rotor and the stator are selected to be pumping, the waves affect in the same direction, promoting the movement of the material in the blade gap, which has both an effect increasing the capacity of the refining and an effect increasing the refining degree. The refining degree increases because the movement in the blade gap takes place as an intensely mixed flow, resulting in both reciprocal refining of fibers and movement thereof and, particularly, movement of heavy, less refined fiber material into the space between the blade bars to be refined there.

When the waves of the rotor are pumping and the waves of the stator are retaining, it may be preferable that the retaining angle of the stator deviates from the pumping angle of the rotor, whereby the material can flow uniformly in the blade gap the whole time and reasonable capacity is made possible, because if the angle were the same, the waves on the counter-surfaces would meet each other at intervals of a wavelength, whereby the material flow would be repeatedly hindered at intervals of a wavelength. The latter may be preferable when intense pressure variation is desirable but the capacity can be compromised, because when the waves meet each other simultaneously, a great change in the pressure is generated, which is then repeated at intervals of a wavelength as the rotor is moving relative to the stator.

If one or more waves 22 in the refining surface are formed both in the rotor and in the stator in such a way that their effect on the material to be refined is pumping, the refining can be implemented with low energy consumption.

If one or more waves 22 in the refining surface are formed both in the rotor and in the stator in such a way that their effect on the material to be refined is retaining, the passage of the material to be refined slows down, which results in a long refining time of the material to be refined, which produces fiber suspension that has been refined to a great extent. In some cases, the applicability of this solution may, however, be restricted by the fact that the amount of energy used for the refining increases significantly, and the quality of the refining may also vary due to fact that the material to be refined may not necessarily proceed controllably and uniformly in the blade gap.

An embodiment where one or more waves 22 in the refining surface of the rotor are arranged to be pumping and one or more waves 22 in the refining surface of the stator are arranged to be retaining is a compromise of the two preceding embodiments, being preferable in the sense that it provides both an efficient pumping effect on the material to be refined and also, on the other hand, simultaneously a relatively long retention time or dwell time of the fiber material in the blade gap. Thus, the material to be refined moves controllably and uniformly in the blade gap and is refined for a long time, remaining still of uniform quality. Also, the energy consumption remains reasonable and good quality is achieved for the fiber material.

A feasible embodiment is also one where one or more waves 22 in the refining surface of the rotor are arranged to be retaining and one or more waves 22 in the refining surface of the stator are arranged to be pumping; a solution is provided where the passage of the material to be refined in the blade gap is relatively slow, which results in a long refining time of the material to be refined, producing thus fiber suspension that has been refined to a great extent. Due to the effect of the pumping waves 22 on the refining surface of the stator, the amount of energy used for the refining remains, nevertheless, reasonable.

A feasible embodiment is also one where one or move waves 22 on the refining surface of the rotor are formed to be pumping, and one or more waves 22 in the refining surface of the stator are formed pumping in the starting portion of the refining surface, closer to the feed edge 14 of the blade segment 11 than to the discharge edge 15, turning then retaining at least in the final portion of the refining surface, closer to the discharge edge 15 of the blade segment 11 than to the feed edge 14. A refiner implemented with such a refining surface solution operates with low energy consumption because the material to be refined moves efficiently and uniformly in the blade gap. In addition, owing to the retaining effect of the final portion of the refining surface of the stator, the refiner is loaded well because a sufficiently thick fiber material layer is formed in the blade gap, which, in turn, leads to a long service life of the refining surface. If the wave in the refining surface of the rotor is particularly pumping, i.e. if its angle relative to radius is close to 45 degrees, the wave in the refining surface of the stator is preferably less pumping, i.e. its angle relative to the radius is relatively great; the fiber suspension stays longer in the refining space, i.e. in the blade gap.

The greatest effect on the behaviour of the material to be refined is obtained from the solution in the refining zone of the refining surface, while a smaller effect is obtained in the feed zone of the refining surface. This is because the refining surface has higher circumferential speeds than the feed zone, whereby the pumping and retaining effects of the solution are emphasized particularly in disc refiners, cone refiners and disc-cone refiners.

Figure 7:
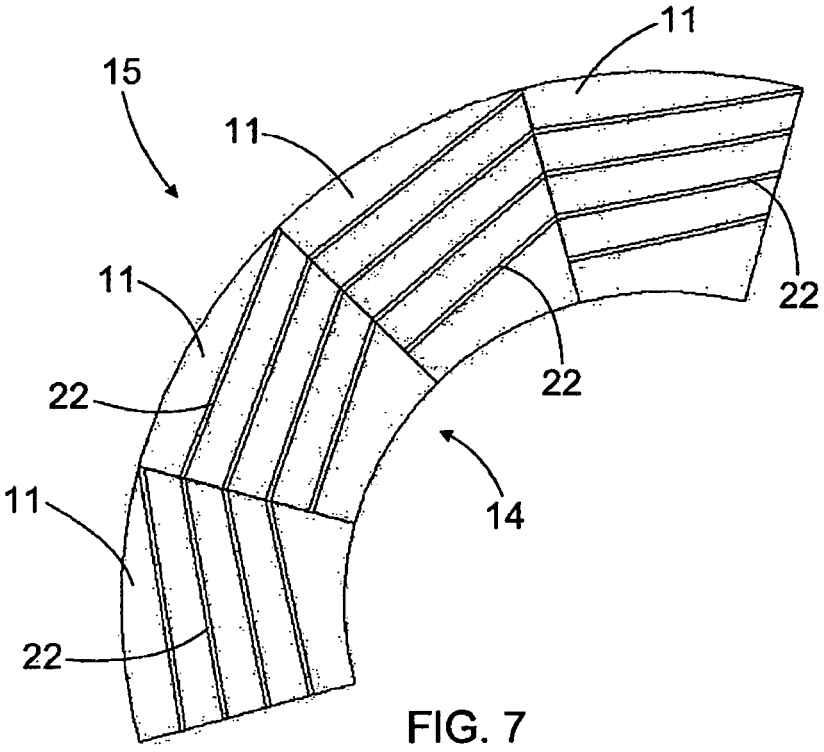
FIG. 7 shows schematically one possible arrangement when the wave shape goes from one blade segment to another.
Figure 8:
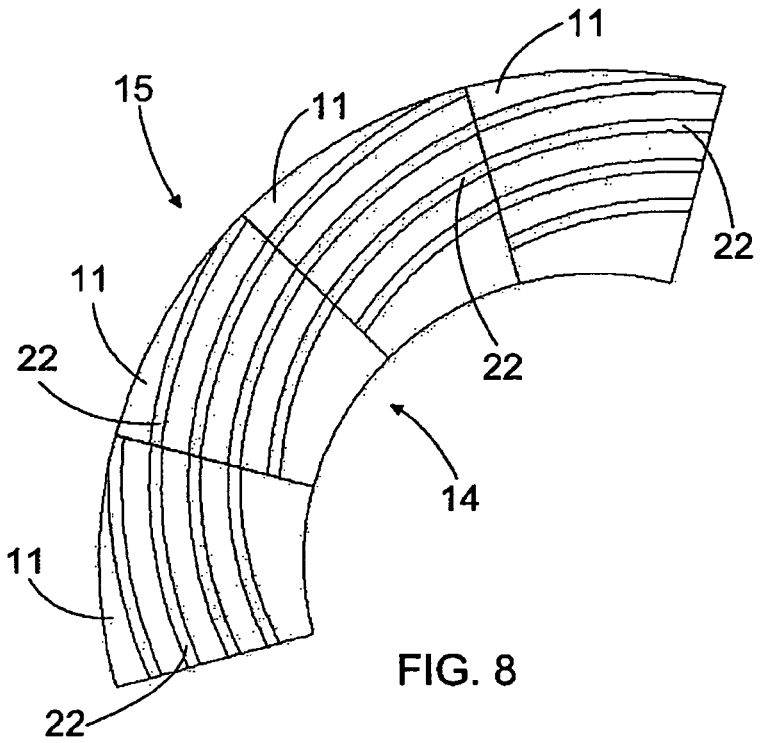
FIG. 8 shows schematically another possible arrangement when the wave shape goes from one blade segment to another.

When a refining surface is formed of blade segments, the blade segments forming a particular refining surface are preferably formed in such a way that each individual wave that continues from one blade segment to another continues in an uninterrupted or substantially uninterrupted manner from one blade segment to another. A substantially uninterrupted continuous wave means, in this case, that there may be a break at the connecting point of two blade segments in this wave, so that this wave does not exist at the connecting point of two blade segments in one of the blade grooves but that the wave continues later in the latter blade segment, having such a shape and such an angle relative to the refining surface radius which can be anticipated on the basis of the shape of the wave in the preceding blade segment. In other words, the wave shape or its imaginary extension is on substantially the same radius at the connecting point of two blade segments at opposite edges of both blade segments. Thus, each individual wave or a whole wave front always proceeds evenly from one blade segment to the adjacent blade segment. A blade surface implemented according to this principle provides a continuous and uniform effect on the material to be refined, whereby a uniform flow is generated. This principle is shown in FIGS. 7 and 8, both of which show a plurality of blade segments 11 arranged adjacent to each other. The waves 22 shown in FIG. 7 have a straight shape across the blade segment 11, and the waves shown in FIG. 8 have a curved shape across the blade segment. For the sake of clarity, the blade bars and blade grooves of the blade segment have been omitted from the blade segments of FIGS. 7 and 8. FIG. 7 shows how each individual wave 22 continues substantially uninterruptedly when one moves from one blade segment to another, maintaining, at the same time, the wave angle relative to the radius of the blade segment the same as can be anticipated on the basis of the shape of the wave in the preceding blade segment.

When both the refining surface of the stator and the refining surface of the rotor have at least one wave 22, it is preferable to position the waves in such a way relative to each other that the angle or rise of the waves is opposite when the refining surfaces in question are against each other. Then, when the refiner is in operation, the waves crisscross and cannot cause such flow hindrance that would be caused if the peaks of the waves were completely against each other. When passing each other, the wave crests generate pressure variation in the blade grooves of the refining surface, whereby the mixing of the material to be refined in the blade gap is boosted, and a larger part of the fibers than before can be guided to the space between the blade bars.

In the above description, the solution has been viewed by means of an individual blade segment and its refining surface but it will be obvious to a person skilled in the art that what has been presented with regard to an individual blade segment and its refining surface also concerns a refining surface formed as one continuous structure. The blade bars of the refining surface may be radial, pumping blade bars, i.e. such blade bars that promote the passage of the material to be refined out of the blade gap between the refining surfaces, or retaining blade bars, i.e. such blade bars that tend to prevent the material to be refined from moving out of the blade gap. Thus, the form of implementation of the blade bars 16 does not impose any restrictions on the implementation of the wave shape or an individual wave 22 on the refining surface.

In some cases, features described in this application may be used as such, irrespective of other features. On the other hand, features described in this application may, if required, be combined to form various combinations.

The drawings and the related description are only intended to illustrate the idea of the invention. Details of the invention may vary within the claims.

The invention claimed is:

1. A refining surface structure of a refiner for a refiner for defibrating lignocellulose-containing material comprising:

the refining surface structure having a feed edge for receiving a feed flow of the lignocellulose-containing material to be refined and a discharge edge for discharging a refined lignocellulose-containing material, the discharge edge spaced from the feed edge;

at least one first blade groove forming a part of the refining surface structure, and defining a first groove bottom;

at least one second blade groove forming a part of the refining surface structure, and defining a second groove bottom;

a blade bar between the first blade groove and the second blade groove, the blade bar having portions defining a blade upper surface;

wherein the first blade groove and the second blade groove define a direction of travel along which the first blade groove and the second blade groove extend;

wherein along the direction of travel, at least a part of said first groove bottom changes substantially continuously such that a distance defined between the bottom of the first blade groove and the upper surface of the blade bar changes substantially continuously in the direction of travel;

wherein along the direction of travel, at least a part of said second groove bottom changes substantially continuously such that a distance defined between the bottom of the second blade groove and the upper surface of the blade bar changes substantially continuously in the direction of travel;

and that in said part of said first groove bottom and said part of said second groove bottom, the distance of the bottom of the first blade groove and the distance of the bottom of the second blade groove from the upper surface of the blade bar are arranged, in the direction of travel of the blade grooves, such that the distance of the bottom of the second blade groove from the upper surface of the blade bar deviates from the distance of the bottom of the first blade groove from the upper surface of the blade bar at substantially the same distance from the feed edge of the refining surface structure.

2. The refining surface structure of claim 1 wherein at least part of the first groove bottom and the second groove bottom change in the direction of travel to form at least one wave.

3. The refining surface structure of claim 2 wherein a radial direction is defined between the feed edge and the discharge edge of the refining surface structure; and wherein the at least one wave extends across the blade bar and is arranged at an angle of 5 to 85 degrees relative to the radial direction of the refining surface.

4. The refining surface structure of claim 1 wherein the bottom of the first blade groove or the bottom of the second blade groove has a point where the distance from the first or second blade groove bottom to the upper surface of the blade bar is greatest, defining a maximum distance; and wherein the first blade groove bottom or the second blade groove bottom extends upwardly a distance which is at most 75% of the maximum distance.

5. The refining surface structure of claim 2 wherein the bottom of the first blade groove or the bottom of the second blade groove in the direction of travel has a form which corresponds to a regular wave shape having a wavelength which is substantially constant.

6. The refining surface structure of claim 5, wherein the regular wave shape corresponds in shape to that of a sine wave.

7. The refining surface structure of claim 2 wherein the bottom of the first blade groove or the bottom of the second blade groove in the direction of travel has a form which corresponds to an irregular wave shape having a wavelength which changes in the direction of travel.

8. The refining surface structure of claim 7, wherein the wavelength of the wave shape gets shorter in the direction of travel.

9. A blade segment for a refiner for defibrating lignocellulose-containing material comprising:

wherein the blade segment has a refining surface and the refining surface has a feed edge for receiving a feed flow of the lignocellulose-containing material to be refined and a discharge edge for discharging a refined lignocellulose-containing material, the discharge edge spaced from the feed edge;

at least one first blade groove forming a part of the refining surface of the blade segment, and defining a first groove bottom, a first groove bottom shape, and each point of the first groove bottom defining a distance from the feed edge;

at least one second blade groove forming a part of the refining surface of the blade segment, and defining a second groove bottom and a second groove bottom shape, and each point of the second groove bottom defining a distance from the feed edge;

a blade bar between the first blade groove and the second groove, and defining a blade upper surface;

wherein the first blade groove and the second blade groove define a direction of travel along which the first blade groove and the second blade groove extend;

wherein along the direction of travel, at least a part of said first groove bottom changes substantially continuously such that a distance defined between the bottom of the first blade groove and the upper surface of the blade bar changes substantially continuously in the direction of travel;

wherein along the direction of travel, at least a part of said second groove bottom changes substantially continuously such that a distance defined between the bottom of the second blade groove and the upper surface of the blade bar changes substantially continuously in the direction of travel; and that in said part of said first groove bottom and said part of said second groove bottom, the distance of the bottom of the first blade groove and the distance of the bottom of the second blade groove from the upper surface of the blade bar are arranged, in the direction of travel of the blade grooves, such that the distance of the bottom of the second blade groove from the upper surface of the blade bar deviates from the distance of the bottom of the first blade groove from the upper surface of the blade bar at substantially the same distance from the feed edge of the refining surface of the blade segment.

10. The blade segment of claim 9 wherein the shape of the bottom of the first blade groove and the shape of the bottom of the second blade groove of the refining surface change in the direction of travel in at least a part of the first blade groove and the second blade groove such that the shape of the bottom of the first blade groove and the shape of the bottom of the second blade groove includes at least one wave such that the distances of the bottom of the first blade groove and the second blade groove from the upper surface of the blade bar change substantially continuously in the direction of travel of the blade grooves.

11. The blade segment of claim 10 wherein the at least one wave forms at least a portion of the shape of the bottoms of the first and second blade grooves so that at corresponding points of the cross-section of said wave transverse to the direction of travel of said first and second blade grooves, the bottoms are arranged at different distances from the upper surface of the blade bar at substantially the same distance from the feed edge of the refining surface.

12. The blade segment of claim 10 wherein a radial direction is defined between the feed edge and the discharge edge of the refining surface of the blade segment; and wherein the at least one wave extends across the blade bar and is arranged at an angle of 5 to 85 degrees relative to the radial direction of the refining surface.

13. The blade segment of claim 9 wherein the bottom of the first blade groove or the bottom of the second blade groove has a point where the distance from the first or second blade groove bottom to the upper surface of the blade bar is greatest, defining a maximum distance; and wherein the first blade groove bottom or the second blade groove bottom extends upwardly a distance which is at most 75% of the maximum distance.

14. The blade segment of claim 10 wherein the bottom of the first blade groove and the bottom of the second blade groove in the direction of travel has a form which corresponds to a regular wave shape having a wavelength which is substantially constant.

15. The blade segment of claim 14 wherein the regular wave shape corresponds in shape to that of a sine wave.

16. The blade segment of claim 10 wherein the bottom of the first blade groove or the bottom of the second blade groove in the direction of travel has a form which corresponds to an irregular wave shape, having a wavelength which changes in the direction of travel.

17. The blade segment of claim 16 wherein the wavelength of the wave shape gets shorter in the direction of travel.

18. A refiner for defibrating lignocellulose-containing material, wherein the refiner comprises:

a stator;

a rotor, mounted for rotation opposed to the stator;

at least one refining surface formed directly on the stator or the rotor, or on at least one blade segment forming the refining surface, wherein the refining surface has a feed edge for receiving a feed flow of the lignocellulose-containing material to be refined and a discharge edge for discharging a refined lignocellulose-containing material, the discharge edge spaced from the feed edge;

at least one first blade groove forming a part of the refining surface and defining a first groove bottom, a first groove bottom shape, and each point of the first groove bottom defining a distance from the feed edge;

at least one second blade groove forming a part of the refining surface and defining a second groove bottom and a second groove bottom shape, and each point of the second groove bottom defining a distance from the feed edge;

a blade bar between the first blade groove and the second blade groove, and defining a blade upper surface;

wherein the first blade groove and the second blade groove define a direction of travel along which the first blade groove and the second blade groove extend; wherein along the direction of travel, at least a part of said first groove bottom changes substantially continuously such that a distance defined between the bottom of the first blade groove and the upper surface of the blade bar changes substantially continuously in the direction of travel;

wherein along the direction of travel, at least a part of said second groove bottom changes substantially continuously such that a distance defined between the bottom of the second blade groove and the upper surface of the blade bar changes substantially continuously in the direction of travel;

and that in said part of said first groove bottom and said part of said second groove bottom, the distance of the bottom of the first blade groove and the distance of the bottom of the second blade groove from the upper surface of the blade bar are arranged, in the direction of travel of the blade grooves, such that the distance of the bottom of the second blade groove from the upper surface of the blade bar deviates from the distance of the bottom of the first blade groove from the upper surface of the blade bar at substantially the same distance from the feed edge of the refining surface; and wherein the shape of the bottom of the first blade groove and the shape of the bottom of the second blade groove of the refining surface change in the direction of travel in at least a part of the first blade groove and the second blade groove such that the shape of the bottom of the first blade groove and the shape of the bottom of the second blade groove includes at least one wave such that the distances of the bottom of the first blade groove and the second blade groove from the upper surface of the blade bar change substantially continuously in the direction of travel of the blade grooves.

19. The refiner of claim 18 wherein a radial direction is defined between the feed edge and the discharge edge of the refining surface; and wherein the at least one wave extends across the blade bar and is arranged at an angle of 5 to 85 degrees relative to the radial direction of the refining surface.

20. The refiner of claim 19 wherein there is a refining surface on the rotor and a refining surface on the stator; and wherein there is at least one wave on both the refining surface of the rotor and on the refining surface of the stator, said waves being arranged to promote the passage of the material to be refined on the refining surfaces.

21. The refiner of claim 19 wherein there is a refining surface on the rotor and a refining surface on the stator; and wherein there is at least one wave on the refining surface of the rotor arranged to promote the passage of the material to be refined on said refining surface and at least one wave on said refining surface of the stator arranged to retain the passage of the material to be refined on the refining surface.

22. The refiner of claim 19 wherein there is a refining surface on the rotor and a refining surface on the stator; and wherein there is at least one wave on the refining surface of the rotor arranged to retain the material to be refined on said refining surface and at least one wave on said refining surface of the stator arranged to retain the passage of the material to be refined on the refining surface.

23. The refiner of claim 19 wherein there is a refining surface on the rotor and a refining surface on the stator; and wherein there is at least one wave on the refining surface of the rotor arranged to retain the passage of the material to be refined on said refining surface and at least one wave on said refining surface of the stator arranged to promote the passage of the material to be refined on the refining surface.

* * * * *